US009150285B2

(12) United States Patent
O'Loughlin et al.

(10) Patent No.: US 9,150,285 B2
(45) Date of Patent: Oct. 6, 2015

(54) ANCHOR ASSEMBLY

(75) Inventors: Conleth Desmond O'Loughlin, Shenton Park (AU); Mark Damian Richardson, Shoalwater (AU)

(73) Assignee: STEVLOS B.V., Capelle Aan Den Ijssel (NL)

( * ) Notice: Subject to any disclaimer, the term of this patent is extended or adjusted under 35 U.S.C. 154(b) by 0 days.

(21) Appl. No.: 14/008,084

(22) PCT Filed: Mar. 30, 2012

(86) PCT No.: PCT/EP2012/055906

§ 371 (c)(1), (2), (4) Date: Nov. 14, 2013

(87) PCT Pub. No.: WO2012/131082

PCT Pub. Date: Oct. 4, 2012

(65) Prior Publication Data

US 2014/0053767 A1 Feb. 27, 2014

(30) Foreign Application Priority Data

Mar. 30, 2011 (GB) ..... 1105372.5

(51) Int. Cl.
*B63B 21/26* (2006.01)
*B63B 21/28* (2006.01)
(Continued)

(52) U.S. Cl.
CPC ..... *B63B 21/26* (2013.01); *B63B 21/29* (2013.01); *E02D 5/80* (2013.01); *B63B 2021/265* (2013.01)

(58) Field of Classification Search
CPC .... B63B 21/24; B63B 2021/26; B63B 21/29; B63B 21/30; B63B 21/46; B63B 2021/20; B63B 2021/206; B63B 2021/24; B63B 2021/265; E02D 5/80
USPC ..... 114/294, 295, 297, 299, 301, 303, 309, 114/310
See application file for complete search history.

(56) References Cited

U.S. PATENT DOCUMENTS 2,993,461 A 7/1961 Feiler
3,118,417 A * 1/1964 Stanwick ..... 114/295
3,604,519 A * 9/1971 Chelminski ..... 173/1
(Continued)

FOREIGN PATENT DOCUMENTS

DE 112 260 C 8/1900
WO 98/49048 A1 11/1998
(Continued)

*Primary Examiner* — Daniel V Venne
(74) *Attorney, Agent, or Firm* — Ladas & Parry LLP

(57) ABSTRACT

An anchor assembly (1) comprises a plate anchor element (2) mounted on an associated dynamic implanting follower (6) to facilitate dynamically embedding the plate anchor element (2) in a mooring bed below a body of water. The plate anchor element (2) has a tubular sleeve (20) which is slidably mounted on a shaft (8) of the implanting follower (6), and locates at an upper end of the implanting follower (6) which has a pointed penetrating tip (9) at a lower end of the shaft (8). Radial flukes (22) are mounted on the sleeve (20) in a cruciform configuration. A through-hole (3) is provided in one of the flukes (22) for attachment of a tether line. For deployment of the plate anchor element (2) the anchor assembly (1) is dropped from a height above the mooring bed, freefalling through the water and penetrating into the mooring bed. The implanting follower (6) is then retrieved leaving the plate anchor element (2) buried in the mooring bed.

17 Claims, 9 Drawing Sheets

(51) Int. Cl.
*E02D 5/80* (2006.01)
*B63B 21/29* (2006.01)

(56) References Cited

U.S. PATENT DOCUMENTS 3,750,609 A * 8/1973 Chelminski ..... 114/295
3,797,255 A * 3/1974 Kammerer et al. ..... 405/225
3,850,128 A * 11/1974 Lovell ..... 114/295
4,312,289 A * 1/1982 Conrad ..... 114/295
4,619,218 A * 10/1986 Kenny ..... 405/228
6,598,555 B1 * 7/2003 Bruce ..... 114/294

FOREIGN PATENT DOCUMENTS

WO 00/26081 A2 5/2000
WO 2004/011327 A1 2/2004

* cited by examiner

ANCHOR ASSEMBLY

RELATED APPLICATION INFORMATION

This application is a 371 of International Application PCT/EP2012/055909 filed 30 Mar. 2012 entitled "An Anchor Assembly", which was published in the English language on 4 Oct. 2012, with International Publication Number WO 2012/131082 A1, and which claims priority from Great Britain Patent Application 1105372.5 filed 30 Mar. 2011, the content of which is incorporated herein by reference.

This invention relates to anchors.

BACKGROUND OF THE INVENTION

Floating facilities require anchors to resist uplift forces due to mooring and environmental loading. Whilst driven piles were initially used to anchor floating installations, difficulties in operating pile hammers precludes this option in deep water. The majority of floating facilities in deep water are moored using either drag anchors, suction caissons, suction embedded plate anchors or dynamically installed "torpedo piles".

Recent innovation means that drag anchors can now withstand the high vertical loads dominant in taut-leg moorings. Furthermore the low mass and size of these anchors mean that an entire anchor suite can be transported to site on a single vessel. However, two major issues remain with the installation of drag embedded vertically loaded anchors.

1. The first issue relates to the drag length of the anchor during installation. This issue is becoming particularly crucial as the industry moves into deeper water as the drag distance increases with water depth, heightening the risk of interference with seabed infrastructure such as pipelines and increasing the need for alternative means of dealing with the excessive amounts of chain and wire required on the anchor handling vessel.
2. The second issue is the sub seabed trajectory of the anchor during installation. This issue is also critical as it dictates the final position and depth of the anchor, and in turn the anchor capacity. As a result, many of the installations involving vertically loaded anchors have necessitated a trial and error approach, resulting in prolonged anchor installation durations and hence costs.

The foregoing difficulties in installing vertically loaded anchors have resulted in renewed interest in the use of suction caissons for deep water installations. They are advantageous as they are capable of withstanding high vertical loads and their position and embedment are readily controlled during installation. However, relative to drag anchors, suction caissons are expensive and of large size and weight, resulting in transportation and deployment problems.

Suction caissons have also been used as a means of installing plate anchors that are similar to the vertically loaded drag anchor referred to previously. In this application, commonly referred to as a Suction Embedded PLate Anchor or SEPLA, the caisson is used to embed an initially vertical plate anchor, located at the caisson base. When the system has reached the design embedment depth, the plate anchor mooring line is disengaged from the caisson, leaving the caisson free to be retrieved and reused for the next installation. At this point the plate anchor is vertically embedded in the seabed. The mooring line attached to the embedded plate anchor is tensioned, causing the plate anchor to rotate or 'key' to an orientation that is perpendicular to the direction of loading. The SEPLA has particular advantages over the suction caisson in that only one caisson is required for the installation process, reducing costs associated with procurement and transportation. However the installation process is still quite involved, requiring the use of pumps to pump water from the interior of the caisson during installation and remotely operated vehicles. These costs are also quite dependent on water depth, making them a less attractive solution for deep water applications.

WO 98/49048 and WO 00/26081 disclose a drag embedment anchor mounted at a lower end of a heavy elongate follower for deployment. The follower with the anchor attached is lowered from a vessel to the seabed. The anchor is then forced into the seabed to a desired depth by the weight of the heavy follower. The follower is then detached and removed leaving the anchor embedded in the seabed.

WO 2004/011327 discloses a method and device for deployment of a sheet anchor. The sheet anchor is mounted at a lower end of a pile which is lowered to the seabed and driven into the seabed by a vibratory hammer, or the like. After deployment of the anchor in the seabed the pile is removed from the sheet anchor.

Dynamically installed anchors, often referred to as torpedo piles, are an economical means of installing anchors in deep water. Dynamically installed anchors are released from a predetermined height above the seabed and rely on their self weight and the kinetic energy gained during freefall to selfbury in the seabed sediments. As no mechanical intervention is required during installation, installation costs are relatively independent of water depth. However these anchors can be extremely large and heavy with overall lengths of up to 22 meters and masses of over 100 tonnes. Hence fabrication and transportation costs can be very high. Furthermore, compared with other anchor types such as plate anchors, they are relatively inefficient at resisting vertical loads and tend to be susceptible to "setup" effects where the anchor capacity can only be realised after a significant period of time after installation has elapsed.

The present invention is directed towards overcoming these problems.

SUMMARY OF THE INVENTION

According to the invention there is provided an anchor assembly including an anchor element having tether attachment means and mounting means for releasably mounting the anchor element on an associated dynamic implanting follower to facilitate dynamically embedding the anchor element in a mooring bed below a body of water in use. Advantageously the invention provides a relatively simple and economical system for burying an anchor in the bed of the body of water by freefall. Conveniently also after deployment the implanting follower is retrieved for re-use.

In one embodiment of the invention the anchor element is releasably engagable with the implanting follower at a position behind a leading tip of the implanting follower. The leading tip of the implanting follower will be the lower end of the implanting follower in use. Thus, advantageously the leading tip of the implanting follower projects below the anchor element when deploying the anchor element which is protected from damage when the freefalling implanting follower impacts with the mooring bed. The force of the impact is taken by the leading tip of the implanting follower. Essentially, the leading tip of the implanting follower forces its way through the mooring bed pulling the anchor element behind it.

In another embodiment the anchor element is engagable with a trailing end of the implanting follower.

In a further embodiment the anchor element is substantially symmetrical about a longitudinal axis of the implanting follower when mounted thereon. This provides a stable and streamlined assembly for freefall through the water and into the mooring bed.

In another embodiment the anchor element is slidably engagable with the implanting follower. Thus conveniently the follower can be readily and easily retrieved from the anchor element after the anchor element has been buried in the mooring bed below the body of water.

In a particularly preferred embodiment the implanting follower has a shaft with the leading tip at one end and the anchor element has a complementary sleeve which is slidably engagable with the shaft, a stop on the shaft for limiting sliding movement of the sleeve on the shaft away from the leading tip of the shaft.

In another embodiment the stop comprises a flanged head at the trailing end of the shaft. The trailing end of the shaft will be the upper end of the shaft in use. This provides a simple and robust construction.

In a preferred embodiment the anchor element is releasably attached to the implanting follower by a shear pin. Thus, the anchor element is securely retained on the shaft until it is deployed in the bed of the body of water and then either during or after deployment, the shear pin ruptures or is ruptured to allow removal and retrieval of the implanting follower for re-use.

In one embodiment of the invention the shear pin is engagable with complementary mounting holes in the anchor element and in the implanting follower.

In another embodiment the mounting holes are located such that when the anchor element and the implanting follower are interconnected by the shear pin, the anchor element is supported on the implanting follower spaced-apart from the stop. Thus, conveniently as the anchor assembly is penetrating into the bed of the body of water, the anchor element can move upwardly along the shaft to engage against the stop at the same time rupturing the shear pin to allow subsequent removal of the implanting follower.

In a further embodiment the head has means for attachment of a lifting cable to the implanting follower.

In a further embodiment the plate anchor element has a number of radial flukes mounted on the sleeve.

Conveniently at least a lower portion of each fluke is curved or tapered. This advantageously facilitates penetration of the bed of the body of water during deployment of the anchor element.

In another embodiment each fluke has a semi-circular shape.

In another embodiment four radial flukes are mounted on the sleeve in a cruciform configuration. Other arrangements such as two, three or more flukes are possible In another embodiment at least one fluke has the tether attachment means. Conveniently each fluke has a tether attachment means.

In another embodiment the tether attachment means is a through hole adjacent an outer edge of the fluke at a central portion of the fluke. Thus, a tethering chain can be easily and quickly attached to the anchor element by a shackle or the like.

In another embodiment the leading tip of the shaft is shaped to facilitate penetration of the shaft into the mooring bed below the body of water.

In another aspect the invention provides a method for dynamically embedding an anchor element in a mooring bed below a body of water including;

mounting the anchor element on an associated dynamic implanting follower, suspending the implanting follower a preset distance above the mooring bed, releasing the implanting follower such that it freefalls downwardly penetrating the mooring bed, and disengaging and lifting the implanting follower away from the anchor element leaving the anchor element embedded in the mooring bed below the body of water.

BRIEF DESCRIPTION OF THE DRAWINGS

The invention will be more clearly understood by the following description of some embodiments thereof, given by way of example only, with reference to the accompanying drawings, in which.

DETAILED DESCRIPTION OF PREFERRED EMBODIMENTS

Figure 5:
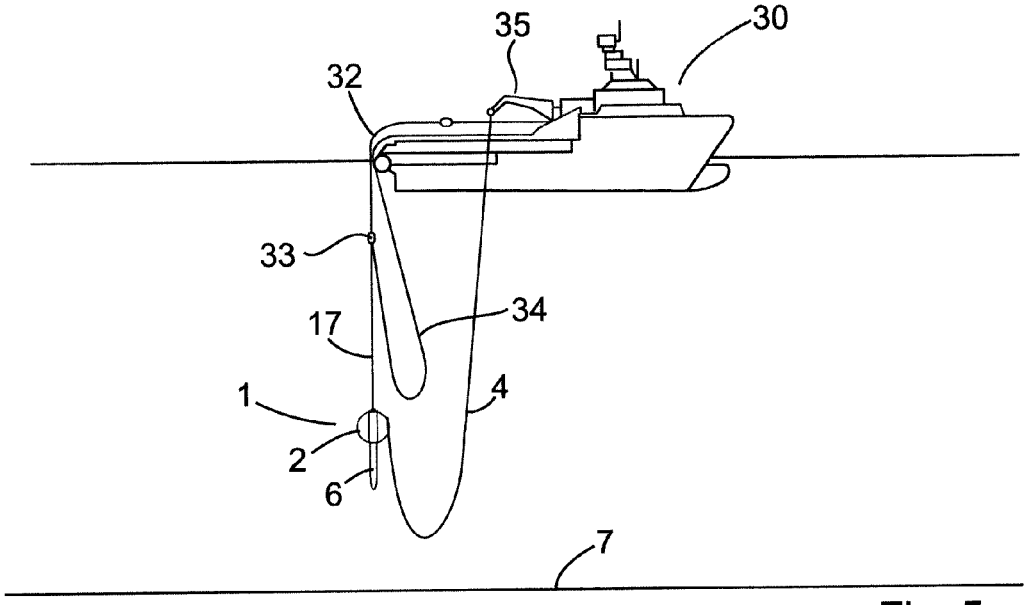
FIGS. 5 to 8 are sequential schematic views illustrating deployment of the anchor assembly in use.
Figure 6:
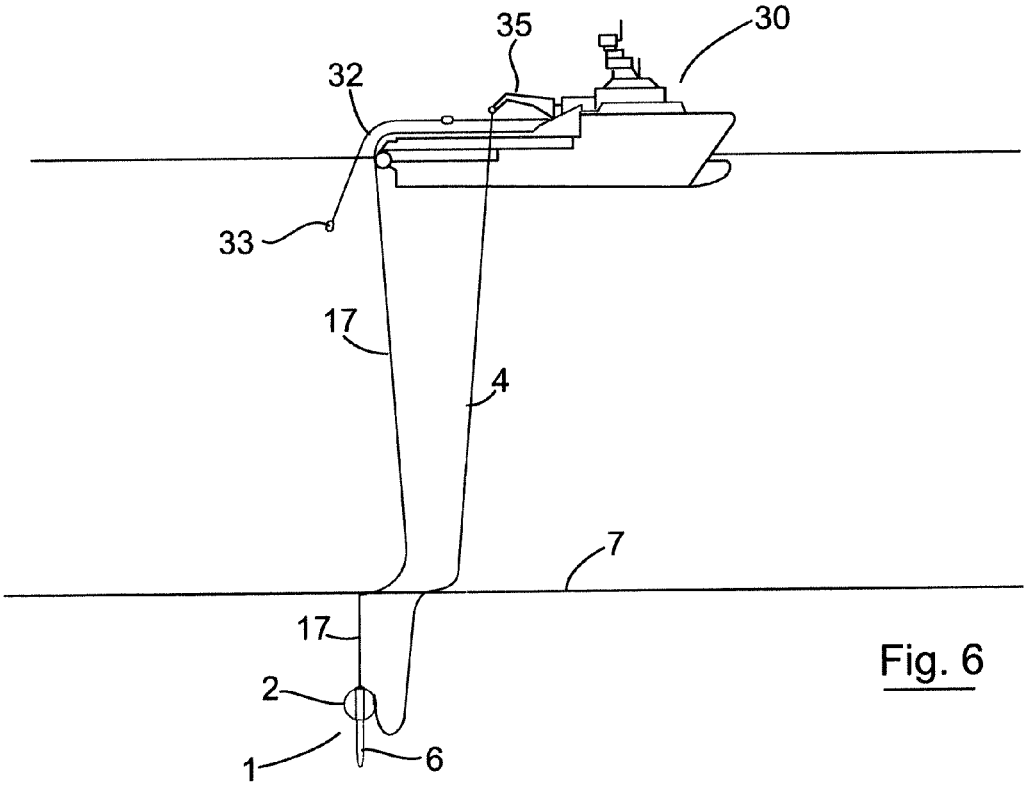
Figure 7:
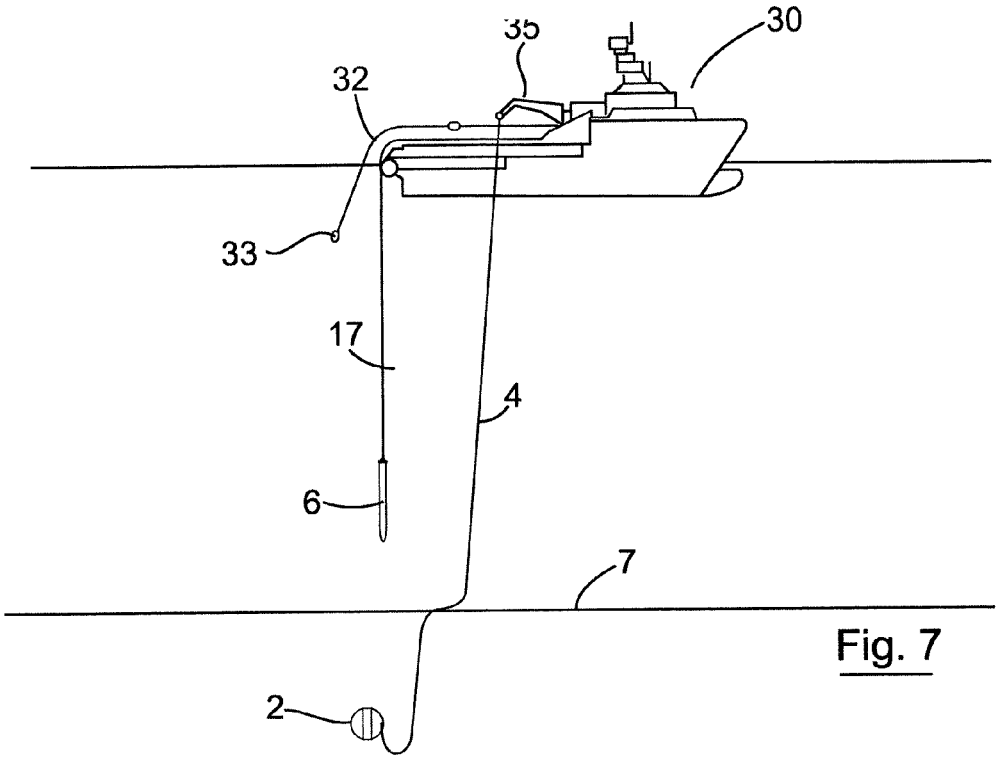

Referring to the drawings, and initially to FIGS. 1 to 9 thereof, there is illustrated an anchor assembly according to the invention indicated generally by the reference numeral 1. The anchor assembly 1 comprises a plate anchor element 2 with a tether attachment 3 for attaching a tethering cable or chain 4. The plate anchor element 2 is mounted on an associated dynamic implanting follower 6 to facilitate dynamically embedding the plate anchor element 2 in a mooring bed below a body of water such as a sea bed 7 in use as shown in FIGS. 5 to 9. Subsequently, the implanting follower 6 can be disengaged from the plate anchor element 2 and retrieved (as shown in FIGS. 7, 9*b* and 9*c*) for re-use with another plate anchor element 2.

The implanting follower 6 has an elongate cylindrical shaft 8 with a pointed leading tip 9 at its lower end 10. A flanged head 11 at an upper trailing end of the shaft 8 projects radially outwardly of the shaft 8 and forms a stop for the plate anchor element 2 at a top of the shaft 8.

An upstanding web 14 on the flanged head 11 has a through-hole 15 for attachment of a shackle 16 (FIG. 9*a*) to secure a lifting cable or chain 17 to the implanting follower 6.

Figure 1:
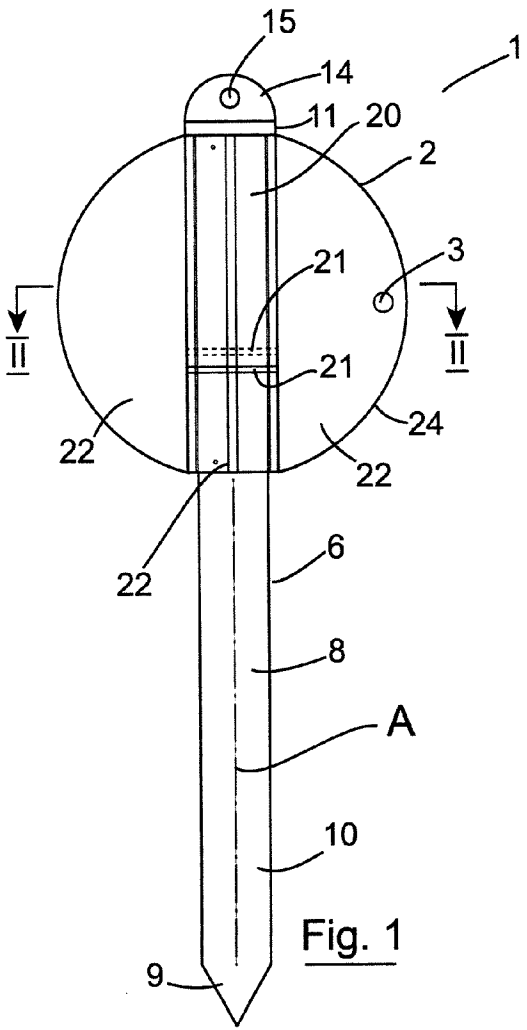
FIG. 1 is an elevational view of an anchor assembly according to the invention.
Figure 2:
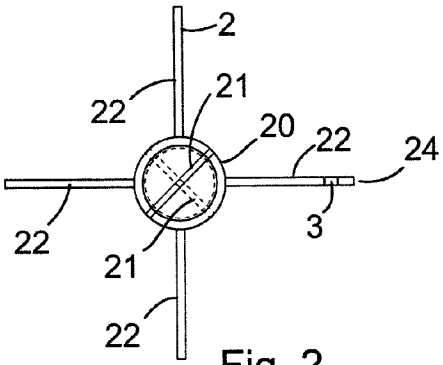
FIG. 2 is a sectional view taken along the lines II-II of FIG. 1.
Figure 4:
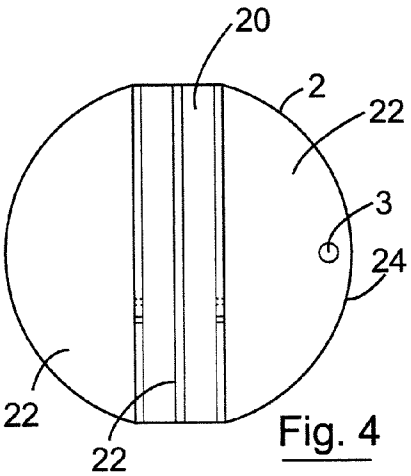
FIG. 4 is a detail elevational view showing a plate anchor element forming portion of the anchor assembly.
Figure 3:
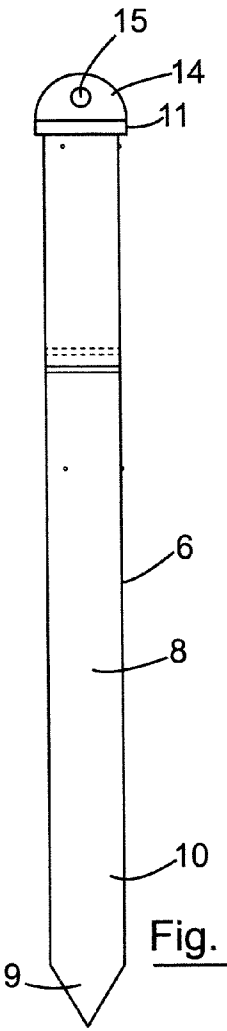
FIG. 3 is a detail elevational view of an implanting follower forming portion of the anchor assembly.

The plate anchor element 2 has a cylindrical sleeve 20, which is slidably engagable with the shaft 8 of the implanting follower 6. Thus, the plate anchor element 2 can slide along the shaft 8 until it engages against the flanged head 11 as shown in FIG. 1. Shear pins 21 extend through complementary holes in the sleeve 20 and follower 6 to retain the plate anchor element 2 on the follower 6. The anchor element 2 is substantially symmetrical about a central longitudinal axis A of the implanting follower 6 when mounted thereon.

Four radial flukes 22 are mounted on the sleeve 20 in a cruciform configuration. Each fluke 22 is semi-circular in shape having a curved outer profile. One of the flukes 22 has a through-hole 3 adjacent an outer edge 24 of the fluke 22 at a central portion of the fluke 22. A shackle 25 (FIG. 9) is engagable with the through-hole 3 for attachment of the tethering chain 4 to the fluke 22.

Referring now in particular to FIG. 5, the anchor assembly 1 is shown mounted on an anchor handling vessel 30 ready for deployment in a sea bed 7 beneath the vessel 30. The anchor assembly 1 is lowered to a desired drop height in the water using a winch line 32 attached to the lifting chain 17 by a release mechanism 33. It will be noted that a bight 34 is provided in the lifting chain 17 to provide a slack portion of lifting chain 17 greater than the drop height. The tethering chain 4 attached to the plate anchor element 2 is held offset from the lifting chain 17 by a crane 35 on the vessel 30.

Referring now in particular to FIG. 6, the second stage of the deployment is shown. The release mechanism 33 is triggered to release the lifting chain 17. The anchor assembly 1 and lifting chain 17 freefall through the water and the anchor assembly 1 embeds itself in the sea bed 7.

Referring now in particular to FIG. 7, the third stage of the deployment is shown. The lifting chain 17 is winched in by the vessel 30 pulling up the lifting chain 17 with the follower 6 attached. Differential resistance on the follower 6 and the plate anchor element 2 causes the shear pin 21 retaining the plate anchor element 2 on the follower 6 to shear. The follower 6 is pulled out of the sea bed 7 and winched on board the vessel 30.

Figure 8:
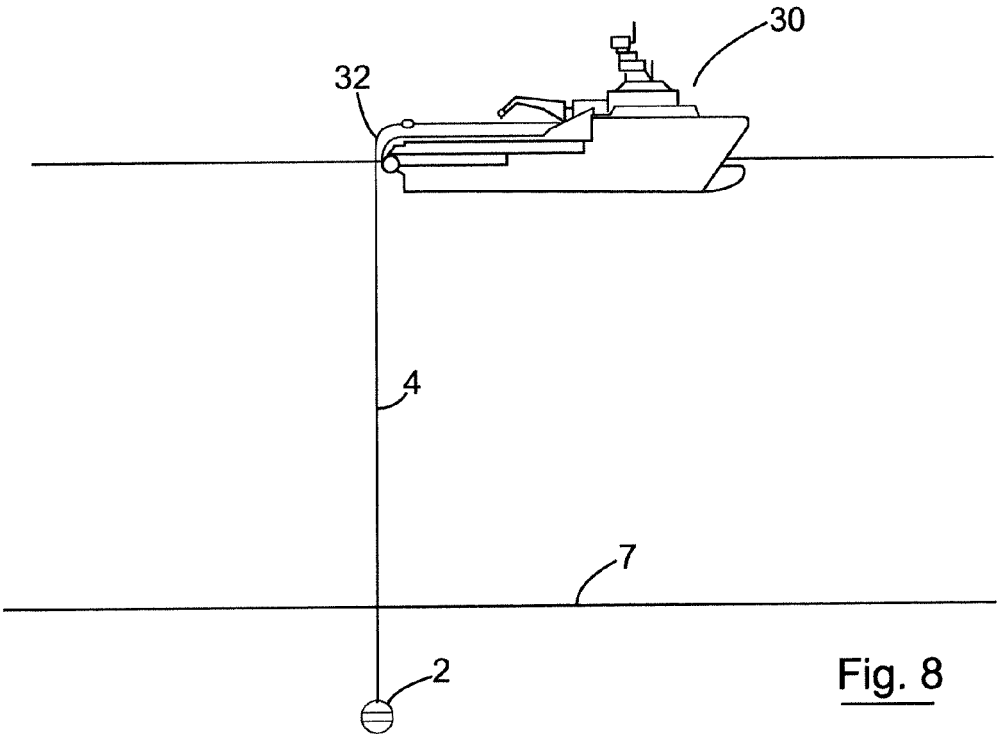
Figure 9:
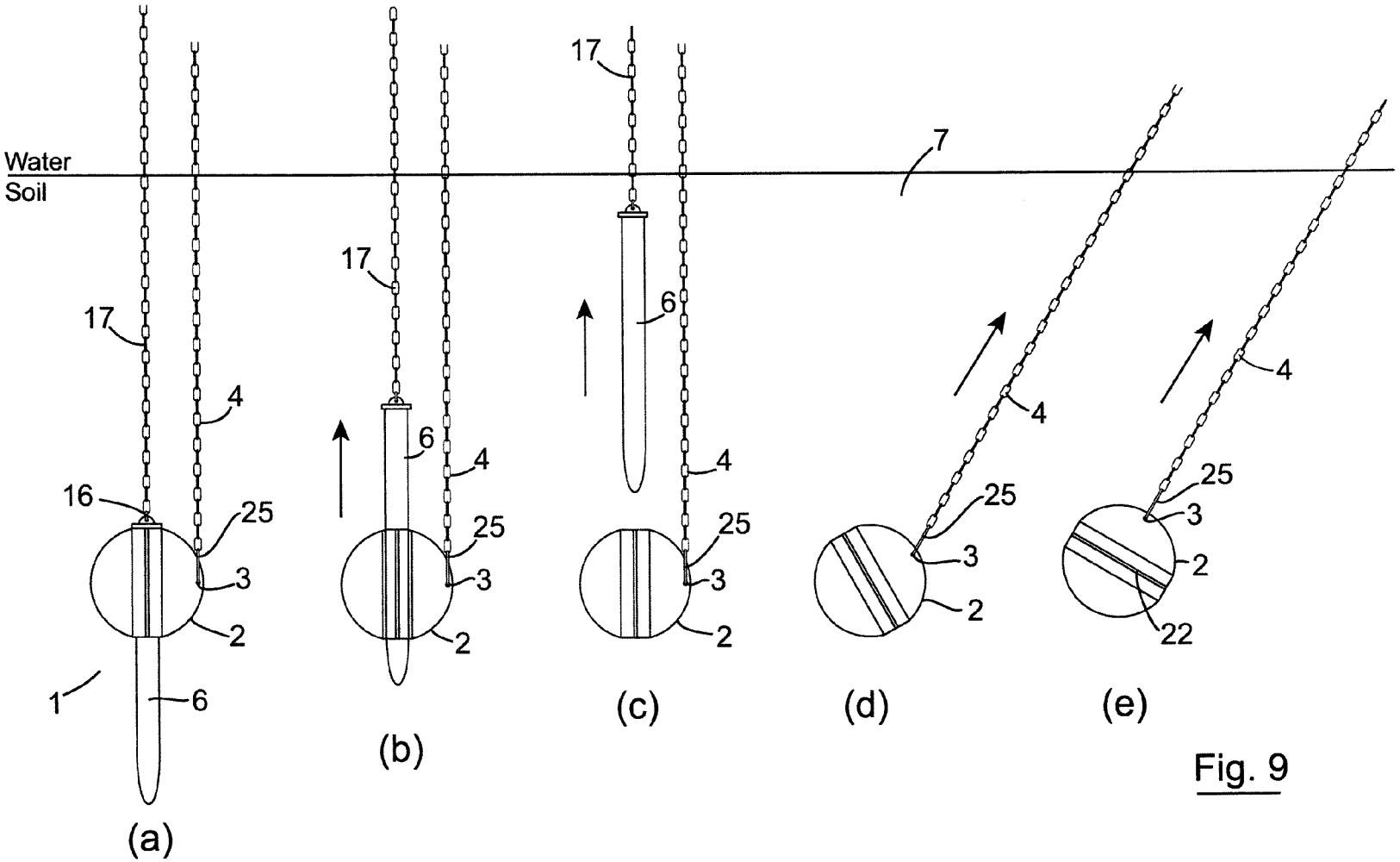
FIG. 9 shows a number of sequential steps in the deployment of the plate anchor element after impaling the anchor assembly in a sea bed in use.

Referring now in particular to FIG. 8, the final stage of deployment is shown. The tethering chain 4 is attached to the drum winch line 32. Then a load is applied to the plate anchor element 2 by the drum winch in order to rotate or key the plate anchor element 2 until it is perpendicular to the direction of loading, that is the side flukes 22 move into a plane perpendicular to the tethering chain 4 to provide maximum resistance. Buoys (not shown) are attached to the end of the tethering chain 4 and deployed until the floating facility which is to be anchored by the tethering chain 4 arrives on site.

It will be appreciated that various other arrangements may be provided for limiting upward movement of the plate anchor element 2 on the implanting follower 6. Also, a range of other suitable shapes for the flukes 22 are possible. It is however, generally desirable that at least a lower portion of each fluke 22 is curved or tapered to aid in penetration into the sea bed 7 during deployment.

It will be appreciated that the anchor assembly and system of the present invention is relatively cheap and easy and quick to install. Also, the installation costs are largely independent of water depth. Further, the follower 6 is conveniently retrieved for reuse after embedding the plate anchor element 2 in the sea bed.

The invention can be used in other water environments such as lakes and rivers where it is desirable to deploy an anchor in a mooring bed below the body of water.

Figure 12:
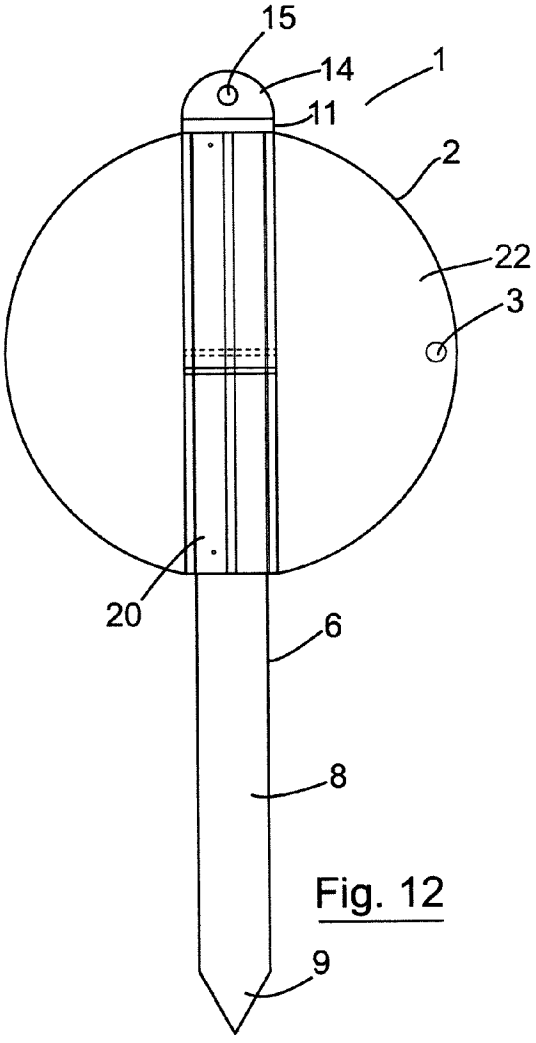
FIGS. 10 to 12 are elevational views showing alternative constructions of anchor assembly in which plate anchor elements of different size are shown mounted on an implanting follower of a standard size.
Figure 11:
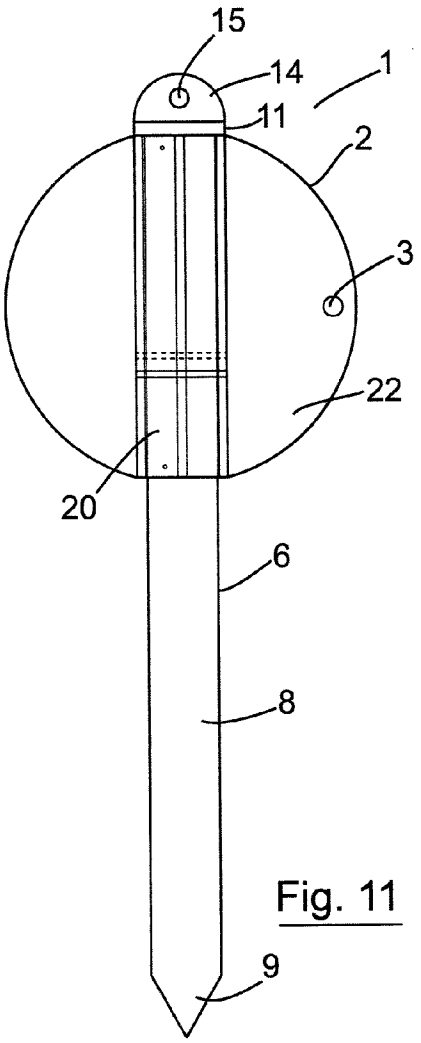
Figure 10:
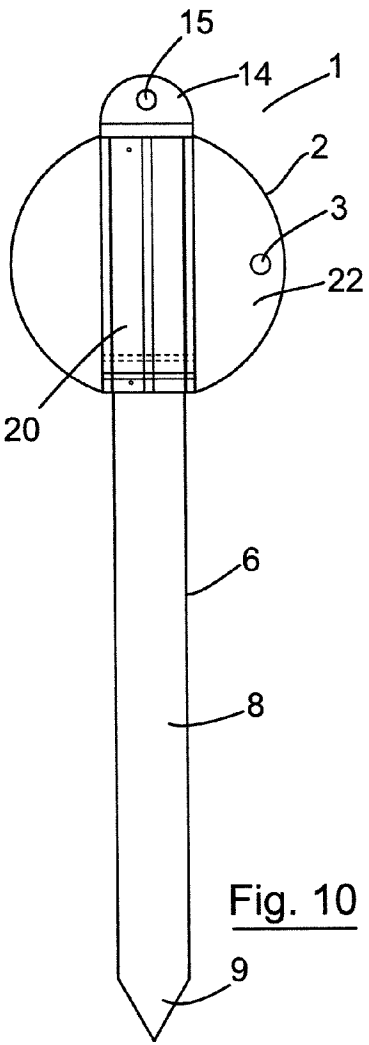

Referring now to FIGS. 10 to 12, some possible variations in the structure of the anchor assembly 1 are shown. Parts similar to those described previously are assigned the same reference numerals. FIG. 10 shows an anchor assembly 1 having a plate anchor element 2 in which the fluke 22 diameter is 30% of the follower 6 length. FIG. 11 shows an anchor assembly 1 having a plate anchor element 2 in which the fluke 22 diameter is 40% of the follower 6 length. FIG. 12 shows an anchor assembly 1 having a plate anchor element 2 in which the fluke 22 diameter is 50% of the follower 6 length.

Figures 13, 14, 15, 16:
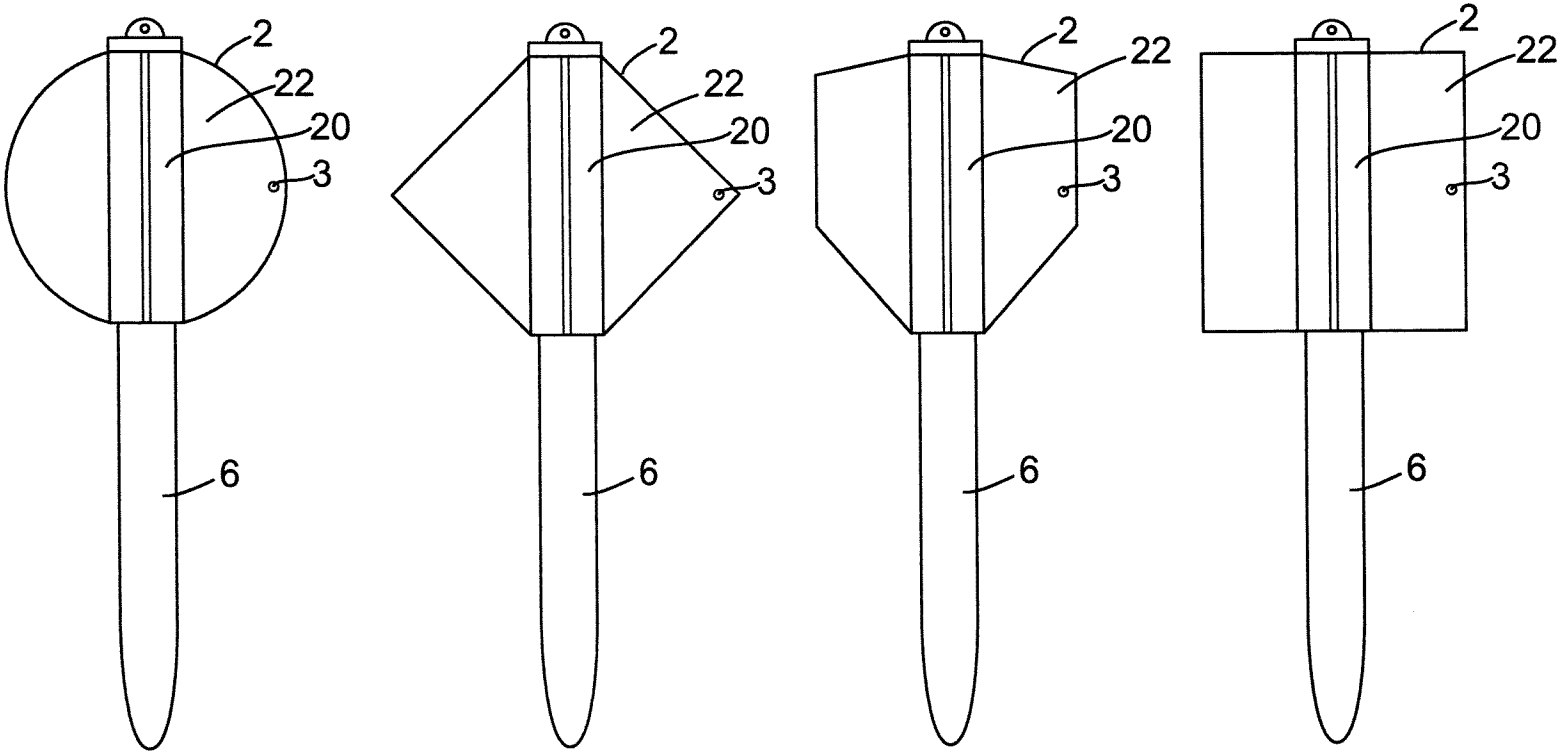
FIGS. 13 to 16 are elevational views showing various embodiments of plate anchor assembly according to the invention in which plate anchor elements of different shape are shown mounted on an implanting follower.

Referring now to FIGS. 13 to 16, various anchor assemblies 1 of the invention are shown illustrating different possible fluke 22 configurations. Parts similar to those described previously are assigned the same reference numerals. FIG. 13 shows an arrangement with semi-circular flukes 22. FIG. 14 shows an arrangement with triangular flukes 22. In FIG. 15 is shown an anchor assembly 1 with clipped delta flukes 22. Rectangular flukes 22 are shown in the anchor assembly 1 of FIG. 16. Any suitable shape of flukes 22 may be used. Ideally the flukes 22 should provide good anchoring characteristics in use and also aid the stability of the anchor assembly during freefall deployment through the water. It will be appreciated that during deployment the anchor assembly 1 is dart-like with the flukes 22 of the anchor element 2 essentially forming the "flights" of the dart which aid in maintaining the implanting follower 6 stable and on course during freefall through the water and seabed.

Figure 19:
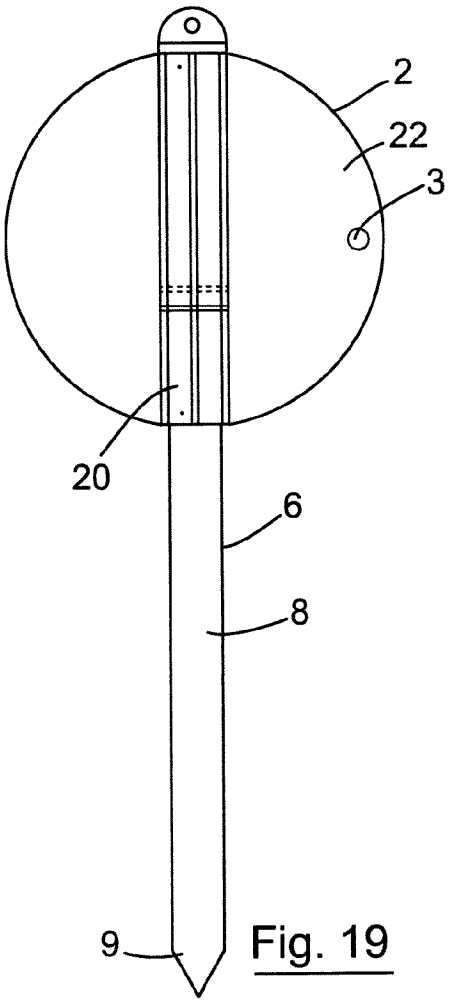
FIGS. 17 to 19 are elevational views showing a number of anchor assemblies according to the invention showing possible variations in the size of the implanting follower.
Figure 18:
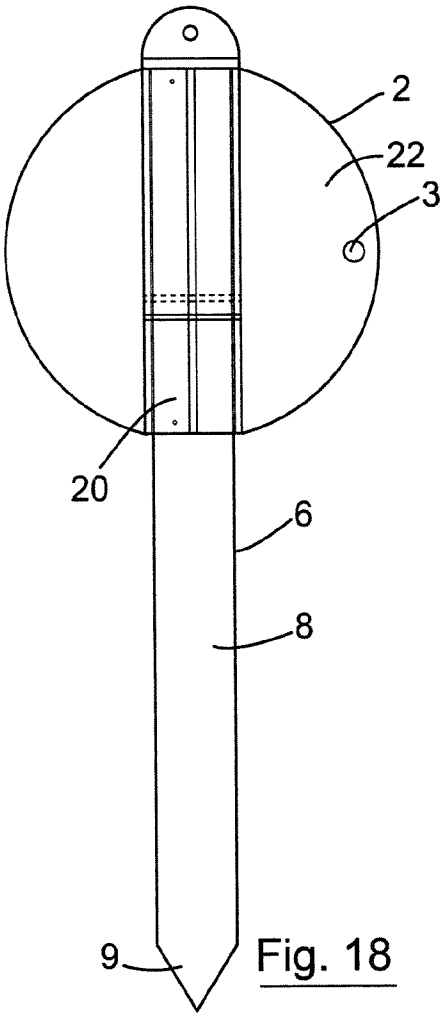
Figure 17:
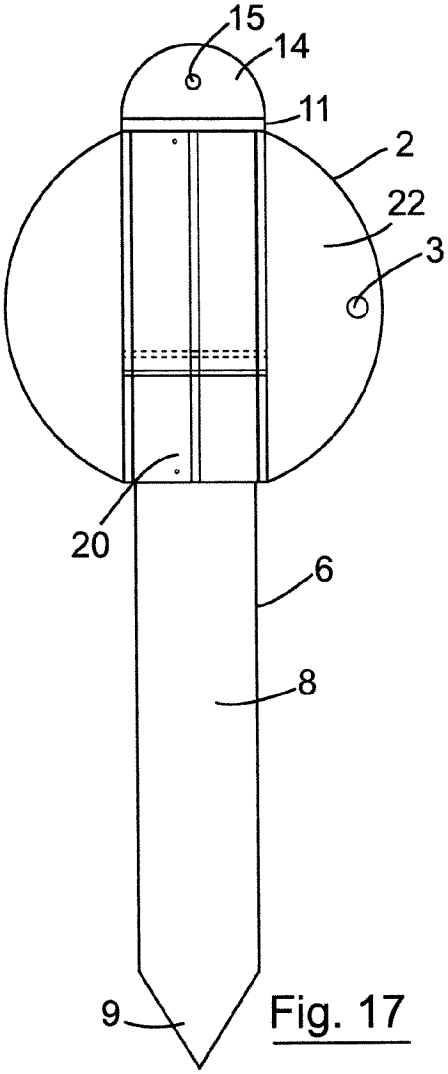

Referring now to FIGS. 17 to 19, anchor assemblies 1 according to the invention are shown with followers 6 of different diameter. FIG. 17 shows a follower 6 having a diameter of 12.5% of the length of the follower 6. FIG. 18 shows a follower 6 having a diameter of 8% of the length of the follower 6 and FIG. 19 shows a follower 6 having a diameter of 5% of the length of the follower 6.

Figure 20:
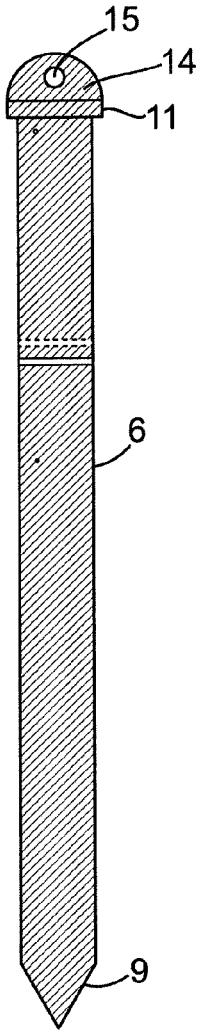
FIGS. 20 to 23 are detail sectional elevational views of the implanting follower showing various possible constructions for the implanting follower.
Figure 21:
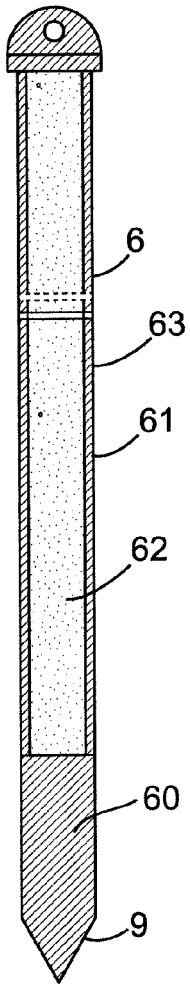
Figure 22:
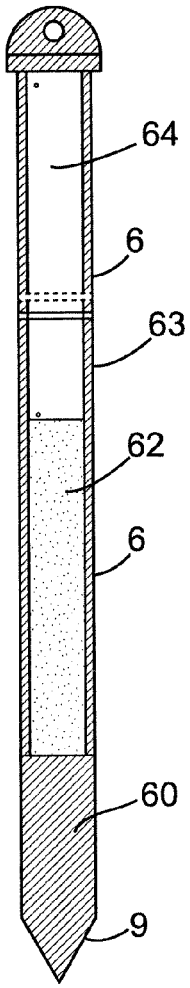
Figure 23:
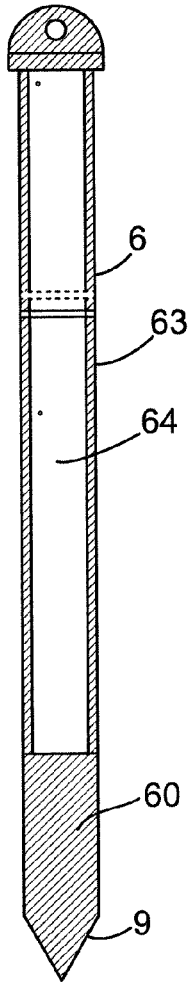
Figure 27:
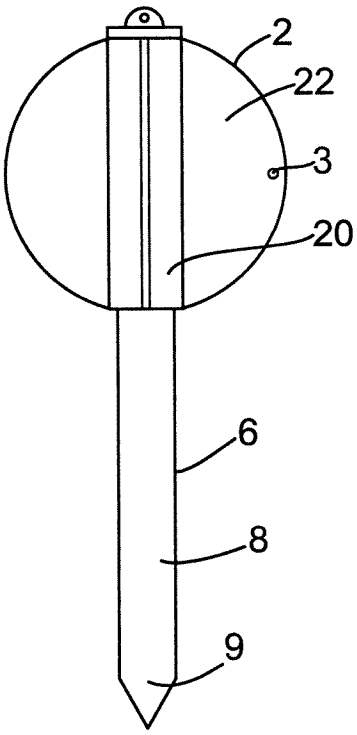
FIGS. 24 to 27 are elevational views of various anchor assemblies according to the invention showing a number of possible variations in a tip at a lower end of the implanting follower.
Figure 26:
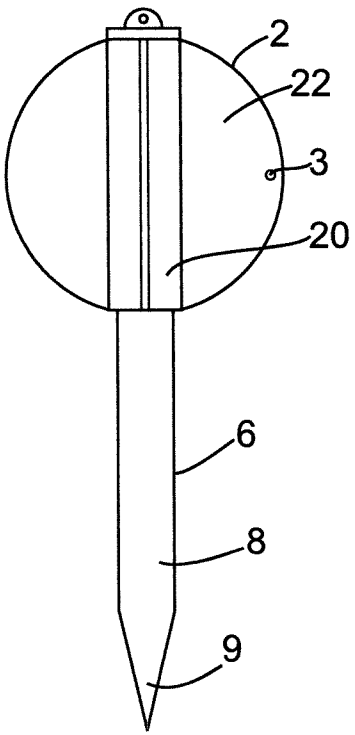
Figure 25:
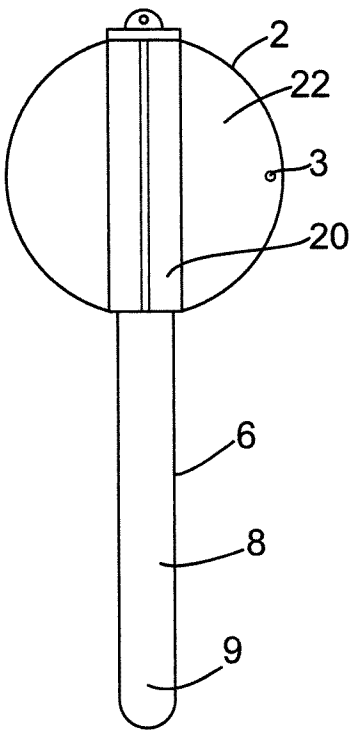

FIGS. 20 to 23 show various constructions of follower 6. The follower 6 shown in FIG. 20 is of solid metal construction. FIG. 21 shows a follower 6 which again is fully solid, but in this case a lower portion 60 of the follower 6 is of solid metal construction, whilst an upper portion 61 comprises concrete 62 in an outer metal casing 63. FIG. 22 shows a partially solid follower 6 with a lower part 60 of solid metal, a mid-part of concrete 62 and an upper part 64 which is hollow. FIG. 23 shows another partially solid follower 6 in this case having a lower portion 60 of solid metal above which is an upper hollow part 64.

Figure 24:
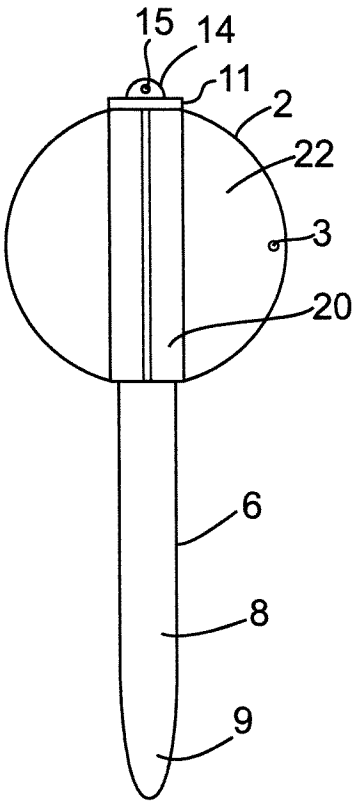

FIGS. 24 to 27 show various arrangements for the tip 9 of the follower 6. FIG. 24 shows an ellipsoidal tip 9, FIG. 25 a hemi-spherical tip 9, FIG. 26 a sharp conical tip 9 and FIG. 27 a blunt conical tip 9.

The invention is not limited to the embodiments hereinbefore described which may be varied in both construction and detail within the scope of the appended claims.

The invention claimed is:

1. An anchor assembly (1) including a plate anchor element (2) having at least one tether attachment (3), wherein the plate anchor element (2) is releasably mounted on an implanting follower (6) to facilitate dynamically embedding the plate anchor element (2) in a mooring bed below a body of water, wherein the implanting follower (6) has a shaft (8) with a leading tip (9) at one end and the plate anchor element (2) has a sleeve (20) which is slidably engagable with the shaft (8), and a stop (11) on the shaft (8) limits sliding movement of the sleeve (20) on the shaft (8) away from the leading tip (9) of the shaft (8), wherein the shaft (8) of the implanting follower passes through the sleeve (20) with the leading tip (9) spaced apart from the sleeve (20), wherein the plate anchor element (2) has a number of radial flukes (22) mounted on the sleeve (20) which form flights thereby giving the anchor assembly (1) a dart-shape.

2. The anchor assembly (1) as claimed in claim 1, wherein the plate anchor element (2) is releasably engagable with the implanting follower (6) at a position behind the leading tip (9) of the implanting follower (6).

3. The anchor assembly (1) as claimed in claim 1, wherein the plate anchor element (2) is releasably attached to the implanting follower (6) by a shear pin (21).

4. The anchor assembly (1) as claimed in claim 3 wherein the shear pin (21) is engagable with complementary mounting holes in the plate anchor element (2) and in the implanting follower (6).

5. The anchor assembly (1) as claimed in claim 4 wherein the mounting holes are located such that when the plate anchor element (2) and the implanting follower (6) are interconnected by the shear pin (21), the plate anchor element (2) is supported on the implanting follower (6) spaced-apart from the stop (11).

6. The anchor assembly (1) as claimed in claim 2, wherein the stop (11) has an upstanding web (14) and a through-hole (15) for attachment of a lifting cable to the implanting follower 6.

7. The anchor assembly (1) as claimed in claim 1, wherein at least a lower portion of each radial fluke (22) is curved or tapered.

8. The anchor assembly (1) as claimed in claim 7, wherein each radial fluke (22) has semi-circular shape.

9. The anchor assembly (1) as claimed in claim 1, wherein at least one radial fluke (22) has a tether attachment (3).

10. The anchor assembly (1) as claimed in claim 1, wherein each radial fluke (22) has a tether attachment.

11. The anchor assembly (1) as claimed in claim 9, wherein the tether attachment is a through hole (3) adjacent an outer edge (24) of the radial fluke (22) at a central portion of the radial fluke (22).

12. The anchor assembly (1) as claimed claim 1, wherein the leading tip (9) of the shaft (8) facilitates penetration of the shaft (8) into the mooring bed below the body of the water.

13. The anchor assembly (1) as claimed in claim 2, wherein the plate anchor element (2) is engagable with a trailing end of the implanting follower (6).

14. The anchor assembly (1) as claimed in claim 1, wherein the plate anchor element (2) is substantially symmetrical about a longitudinal axis of the implanting follower (6) when mounted thereon.

15. The anchor assembly (1) as claimed in claim 1, wherein the stop (11) is a flanged head at a trailing end of the shaft (8).

16. The anchor assembly (1) as claimed in claim 1, wherein four radial flukes (22) are mounted on the sleeve (20) in a cruciform configuration.

17. A method for dynamically embedding a plate anchor element (2) in a mooring bed (7) below a body of water using an anchor assembly, wherein the anchor assembly (1) includes a plate anchor element (2) and an implanting follower (6), wherein the plate anchor element (2) has a tether attachment (3), wherein the plate anchor element (2) is releasably mounted on the plate anchor element (2) on the implanting follower (6) to facilitate dynamically embedding the plate anchor element (2) in the mooring bed below the body of water, wherein the implanting follower (6) has a shaft (8) with a leading tip (9) at one end and the plate anchor element (2) has a sleeve (20) which is slidably engagable with the shaft (8), and a stop (11) on the shaft (8) for limiting sliding movement of the sleeve (20) on the shaft away from the leading tip (9) of the shaft (8), wherein the shaft (8) of the implanting follower passes through the sleeve (20) with the leading tip (9) spaced apart from the sleeve (20), wherein the plate anchor element (2) has a number of radial flukes (32) (22) mounted on the sleeve (20) which form flights, wherein the method comprises:

mounting the plate anchor element (2) on the implanting follower (6), suspending the implanting follower (6) above the mooring bed (7), releasing the implanting follower (6) such that the implanting follower (6) freefalls downwardly penetrating the mooring bed (7), and disengaging and lifting the implanting follower (6) away from the plate anchor element (2) leaving the plate anchor element (2) embedded in the mooring bed (7) below the body of water.

* * * * *